US010669731B2

(12) United States Patent
Rojas

(10) Patent No.: US 10,669,731 B2
(45) Date of Patent: Jun. 2, 2020

(54) ACCESSORIES TO COVER AND PROTECT A POOL FROM THE OUTSIDE ENVIRONMENT

(71) Applicant: Gabriela Arisvette Rojas, Surprise, AZ (US)

(72) Inventor: Gabriela Arisvette Rojas, Surprise, AZ (US)

( * ) Notice: Subject to any disclaimer, the term of this patent is extended or adjusted under 35 U.S.C. 154(b) by 0 days.

(21) Appl. No.: 15/890,214

(22) Filed: Feb. 6, 2018

(65) Prior Publication Data

US 2019/0242145 A1 Aug. 8, 2019

(51) Int. Cl.

| | |
|---|---|
| ***E04H 4/10*** | (2006.01) |
| ***E04H 4/08*** | (2006.01) |
| ***E04H 15/20*** | (2006.01) |
| ***E04H 15/18*** | (2006.01) |
| ***E04H 15/02*** | (2006.01) |
| ***E04F 10/02*** | (2006.01) |
| ***A47C 29/00*** | (2006.01) |

(52) U.S. Cl.

CPC ..... *E04H 4/108* (2013.01); *E04H 4/084* (2013.01); *E04H 15/02* (2013.01); *E04H 15/18* (2013.01); *E04H 15/20* (2013.01); *A47C 29/006* (2013.01); *E04F 10/02* (2013.01)

(58) Field of Classification Search

CPC ..... E04H 4/108; E04H 4/084

USPC ..... 4/498

See application file for complete search history.

(56) References Cited

U.S. PATENT DOCUMENTS

| | | | | |
|---|---|---|---|---|
| 2,875,825 | A * | 3/1959 | Soares | E04F 10/10 160/134 |
| 3,566,420 | A * | 3/1971 | Peterson et al. | E04H 4/084 4/494 |
| 6,081,944 | A * | 7/2000 | Edwards | B63J 2/00 4/496 |
| 6,405,679 | B1 * | 6/2002 | Sonnek | A01K 31/14 119/432 |
| 2004/0055081 | A1 * | 3/2004 | Wilson | E04H 4/084 4/498 |
| 2008/0263759 | A1 * | 10/2008 | Chapus | E04H 3/165 4/498 |
| 2019/0078345 | A1 * | 3/2019 | Harder | E04H 4/144 |

* cited by examiner

*Primary Examiner* — Christine J Skubinna
(74) *Attorney, Agent, or Firm* — Perkins Coie LLP

(57) ABSTRACT

Provided in this disclosure is a pool with a cover to provide shade to the pool's occupants. The cover is supported by poles. The cover can also be raised for use to provide shade and shelter to occupants and lowered to protect the pool from contaminants when it is lowered. The cover can have certain attachments, such as a mosquito net or misters. The mosquito net prevents bugs from entering the pool and misters provide a cool mist for users of the pool. Also provided is a cover having a series of overlapping panels that can be collected into and retracted out of a collector panel.

16 Claims, 10 Drawing Sheets

ACCESSORIES TO COVER AND PROTECT A POOL FROM THE OUTSIDE ENVIRONMENT

TECHNICAL FIELD

This disclosure relates to pool accessories.

BACKGROUND

During warmer weather—and year-round—people often enjoy swimming in above-ground and in-ground pools. People also enjoy hot tubs, a type of above-ground or in-ground pool. These pools and hot-tubs, however, are often outdoors, and thus, exposed to the environment. This results in sun-burns, mosquito bites, and discomfort. What is needed are accessories to reduce the negative impact of the environment.

SUMMARY

Provided within this disclosure are embodiments of a pool with a covering apparatus. The pool has least one pole, the pole being configured to raise and lower vertically via a change in fluid pressure, such as air, within the pole, wherein the pole has at least one entry point, the entry point allowing an external pump to connect to it via a connector, the pole being attachable to at least one portion of a pool, and a cover, the cover being configured to raise and lower with the at least one pole.

In an embodiment, an external pump is connected, directly or indirectly, to the entry point. In another embodiment, a support pole is connected to the telescopic pole. In another embodiment, the pole is connected to an above ground pool. In yet another embodiment, the pole is connectable to an in-ground pool. In another embodiment, a pipe is connectable to the entry point and an external pump. In another embodiment, the pole further comprises cover holders. In another embodiment, the support pole further comprises a clamp. In another embodiment, the pole further comprises a clasp, the clasp allowing the cover to be held in place at a predetermined height.

In yet another embodiment, a mosquito net is attachable to the cover to prevent bugs from entering into the pool. In yet another embodiment, at least one water mister is attachable to the cover. In yet another embodiment, the mister is attachable to the cover via a pipe. In yet another embodiment, the pipe is attachable to a hose that is connected to an external water source. In yet another, the poles are raised and lowered electronically via an external pump.

In an embodiment, the cover has a series of panels that expand out over the cover. In another embodiment, the cover further comprises a collector panel that collects the series of panels to retract the panels from the cover.

In an embodiment, a pool system provides means to support a cover, means to raise a cover, and means to attach the means to support the cover to a pool. In another embodiment, the pool comprises means to provide misting. In another embodiment, the pool comprises means to provide protection from insects or bugs.

DETAILED DESCRIPTION

The disclosure provides techniques, systems, and devices related to pools. In an embodiment, a cover is provided to provide shade and cover to a pool. The cover includes a mechanism, such as four telescopic poles, to raise and lower the cover. The cover can be raised through pneumatics—fluid pressure can be increased/decreased to raise/lower the telescopic poles holding the cover. Air pressure can be provided via a valve or an electronically controlled valve. When fully raised, the poles have clamps that secure the pool cover in place when it is raised. The cover with poles can be removably attachable to the pool, or fixably attached via bolts or other fasteners.

In another embodiment, a mosquito net is provided. The mosquito net can be fixably or removably attachable to the cover. In another embodiment, the mosquito net can have floatable devices on the net's bottom portion to keep portions of the net afloat in the pool. In another embodiment, the cover has sprinklers or misters connected around the side of the cover. Water can be delivered from an outside hose or plumbing.

In another embodiment, the cover is made up of a series of panels. The series of panels are designed to be collected into and retracted out of a collector panel. The panels are operated via motor.

Figure 1:
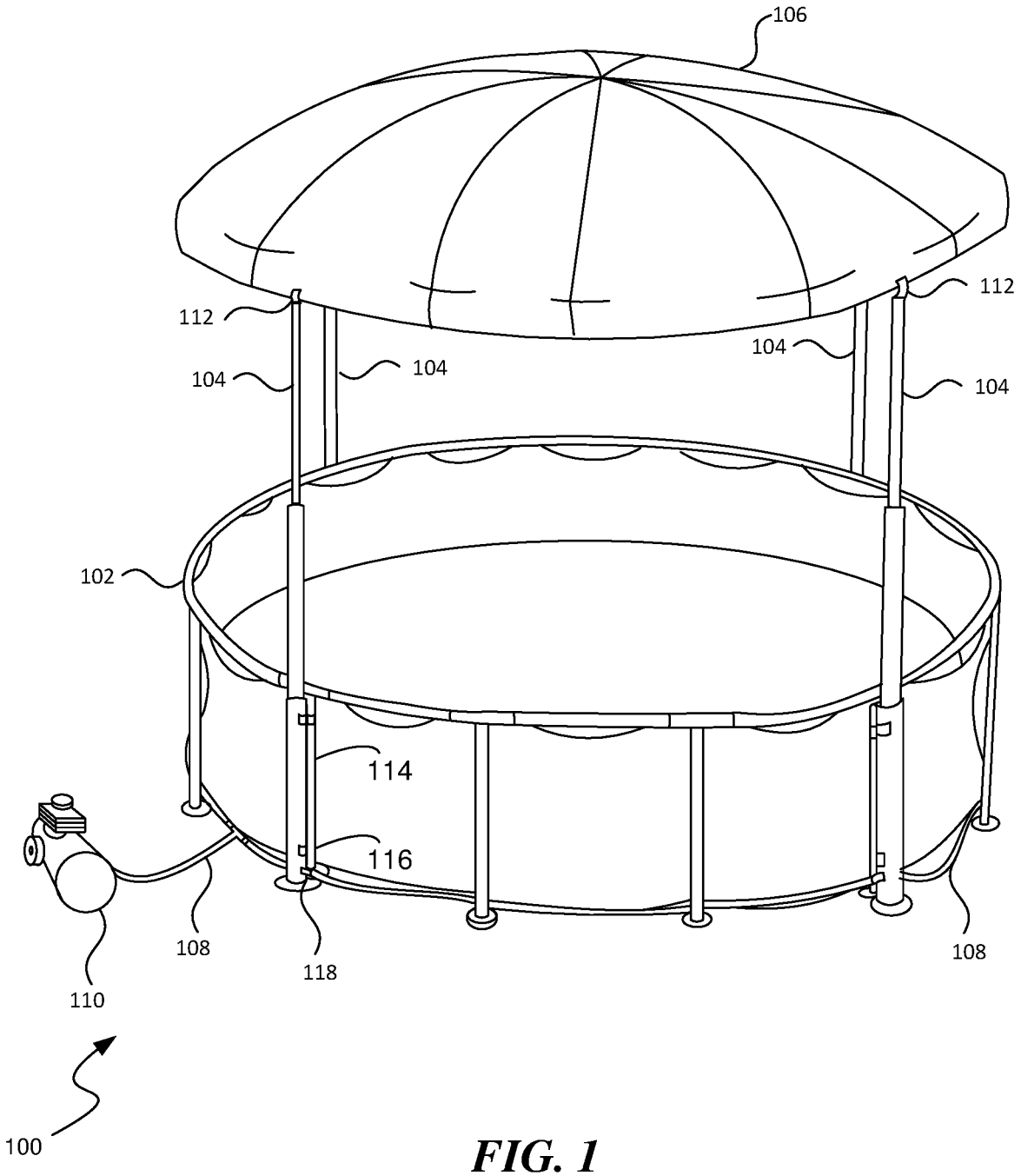
FIG. 1 illustrates an exemplary pool with a cover.

Shown in FIG. 1 is an exemplary pool system 100. An above ground pool 102 is filled with water (water not shown). Although shown as an above ground pool 102, it should be understood that the disclosure applies to in-ground pools, hot-tubs, and the like. The pool 102 can be constructed of any plastics, cements, or other materials known in the art.

The pool 102 has four telescopic poles 104 that hold up a cover 106. The cover 106 provides partial or complete shade and shelter to the occupants of the pool 102. The cover 106 is a plastic, but it should be understood that the cover 106 can be any material known in the art. In an embodiment, the cover 106 is a fabric held together by a plastic or metal skeleton. In another embodiment, the cover is fabric. In another embodiment, the cover is a series of panels. The telescopic poles 104 can also be made of any known material, such as a plastic or a metal.

As illustrated, the cover 106 is shown as being dome-like. The shape, however, should be understood to be any shape known in the art. It can be flat or sloped, or circular, rectangular, or square. It can also have n-sides, such as being hexagonal.

The telescopic poles 104 raise and lower the cover 106 using pneumatic pressure via pipes 108. Although described as being raised using pneumatic pressure, any mechanism of raising the shade can be employed. It should be understood that the cover can be physically raised, where a person exerts physical force to raise the poles. It should also be understood that the poles can be raised via an electro-mechanical motor. In an embodiment, the poles also have slots or other mechanisms at certain intervals allowing them to be raised to predetermined heights.

An air pump 110 provides air pressure via the pipes 108 to raise and lower the telescopic poles 104. Each of the telescopic poles 104 has an entry hole 118 allowing air to go into and go out of the telescopic poles 104. Air pressure can be injected into telescopic poles 104 to raise or lower the cover 106 via a mechanically actuated valve or via electronic actuation. Air can be delivered by the push of a button or the flipping of a valve. In another embodiment, the air pump 110 can use any type of fluid to change pressure.

The cover 106 is supported via cover holders 112 that are at the end of the telescopic poles 104. The telescopic poles 104 are supported by the pool 102 structure. The telescopic poles 104 are physically attached to support poles 114 of the pool 102 via clasps 116. It should be understood that the telescopic poles 104 can be removably attached to the support poles 114 for easy storage. It should be understood that the clasps can be any type of mechanical structure that accomplishes the function of holding the poles. In an embodiment of an in-ground pool, the telescopic poles 104 can be placed in the ground via a housing.

When fully raised, the telescopic poles 104 can be locked via clamps (not shown) to lock the cover 106 in place. In an embodiment, clamps are provided at multiple predetermined heights so that the height that the cover can be raised to is adjustable. At each predetermined height, the user can decide whether to maintain the shade at the current height or raise it further or lower it further.

The cover 106 can be raised to provide shade to a portion or all of the pool 102 when in use. It should be understood that this would be desirable to protect swimmers from sun burn or when direct contact from the sun is undesirable. The cover 106 can also provide a sense of shelter to the swimmers within the pool 102.

In addition to being raised, the cover 106 can also be lowered to cover the pool 102. This can be done during night, during colder weather, or whenever the pool 102 is not being used. In an embodiment, the cover 106 is sturdy enough to support the weight of a person to prevent the cover from collapsing if, for example, a kid steps on it when it is lowered. The cover 106 can also be lowered to other predetermined heights. To lower the cover, a user would electronically or physically actuate the pneumatic pressure. The clamps holding the cover 106 up at a predetermined height can be physically or electronically disengaged to allow for easier lowering of the cover.

In an embodiment, the pump 110 has settings to allow certain predetermined heights of the cover 106 to be reached. A user actuates one of those predetermined settings to raise the cover 106 to a predetermined height.

In an embodiment, the cover 106 slightly overlaps the outer portion of the pool 102 to create a seal when lowered. This can be beneficial to prevent contaminants from entering the water of the pool 102 when the pool 102 is not in use.

In another embodiment, the cover 106 can cover only a portion of the pool 102. This can provide partial shading and shelter to the pool. This may be desirable to allow certain sections of the pool 102 to have sun or be otherwise exposed to the environment, while others that have shade or are otherwise partially or completely protected from the environment. In yet another embodiment, the cover 106 can extend far beyond the perimeter pool 102 in one or more directions. This may be desirable to provide shade for the entirety of sun positions and protect all swimmers, wherever they may be within the pool, from sun. In one embodiment, the extension of the cover 106 beyond the perimeter of the pool 102 provides shade for the entirety of sun positions for a portion of the pool.

It should be understood that each of the components described herein can be removed and reattached for easy storage. This allows the pool or the components to be easily stored. For example, for above-ground pools or pools which otherwise can be disassembled, it is desirable to store the pool during winter or whenever the space typically occupied by the pool 102 is needed for other activities. The telescopic poles 104 can be removable from the support poles 114. The cover 106 can also be removed from the cover holder 112. The pipes 108 can also be attached to the entry holes 118 via clasp or can be screwed on.

In an embodiment of an in-ground pool, the telescopic poles 104 can be buried under ground, along with the connecting pipes 108 or hoses. When the air pump 110 applies air pressure, the telescopic poles 104 extend out of the ground and the cover 106 rises. When air pressure is decreased, the telescopic poles 104 retract into the ground and the cover 106 lowers to cover the pool 102. The raised cover 106 provides shade when the telescopic poles 104 are extended and a cover for the pool 102 when not in use when the telescopic poles 104 are retracted. In an embodiment, for safety, the cover 106 is strong enough to hold the body-weight of a person to ensure that they will not fall into the pool 102 when the telescopic poles 104 are retracted and the pool 102 is covered with the cover 106.

Figure 2:
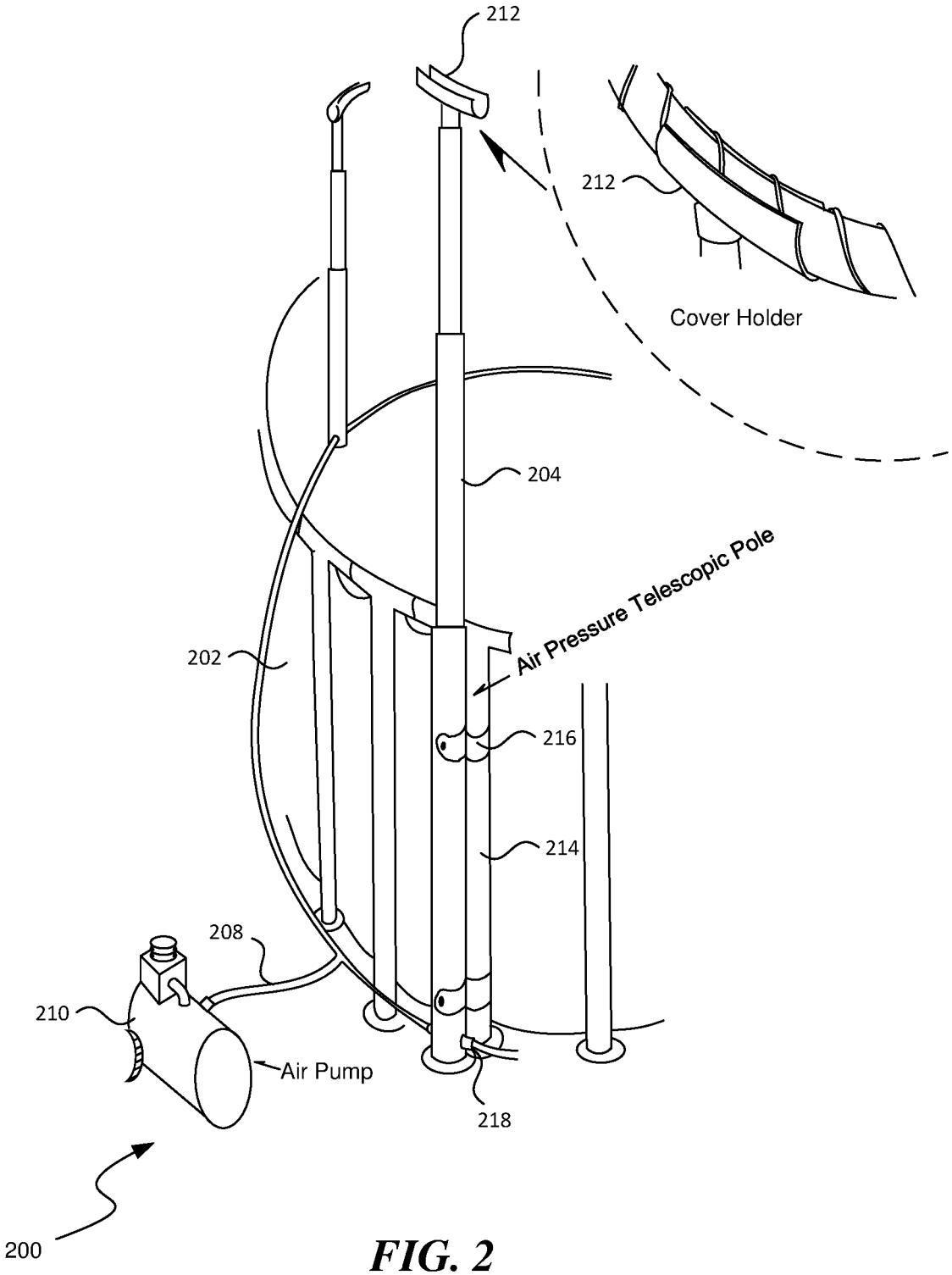
FIG. 2 illustrates a zoomed in view of exemplary telescopic poles used with a pool.

Shown in FIG. 2 is a zoomed in view of an exemplary telescopic pole system 200. Telescopic pole 204 is fixably attached to support poles 214 of the pool 202 via clasps 216. Air pressure is added to the system by the air pump 210 via pipes 208 to the telescopic pole 204 to extend or retract the telescopic pole 204. Each of the telescopic poles 204 has an entry hole 218 to allow air pressure to enter the telescopic pole 204.

The pipes 208 can be screwed or snapped into the entry hole 218. It should be understood that any method of removable attachment can be used, such as a screwing, snapping, bolting, or pressure attachment means. Higher air pressure injected into the telescopic poles 204 raises them and lower air pressure lowers them.

The telescopic pole 204 can be removably attachable to clasps 216 that are attached to support poles 214. The support poles 214 can be a part of the pool 202 or can be a separate component in the case of a pool or hot-tub that is not above around. The telescopic pole 204 can be attached to the clasps 216 via a screw or bolt or other fastener, or can be snapped on. The clasps 216 support the telescopic poles 204. The telescopic poles 204 support the cover (not shown). Also illustrated is a cover holder 212 as part of the telescopic pole 204. The covered holder 212 supports the cover (note shown).

It should be understood that each of the components can be removed and reattached for easy storage. This beneficially allows the system to be stored in colder weather or when a space occupied by the pool is needed for other activities. The telescopic poles 204 can be removable from the support poles 214. The cover 206 can also be removed from the cover holder 212. The pipes 208 can also be attached to the entry holes 218 via clasp or can be screwed on.

Figure 3:
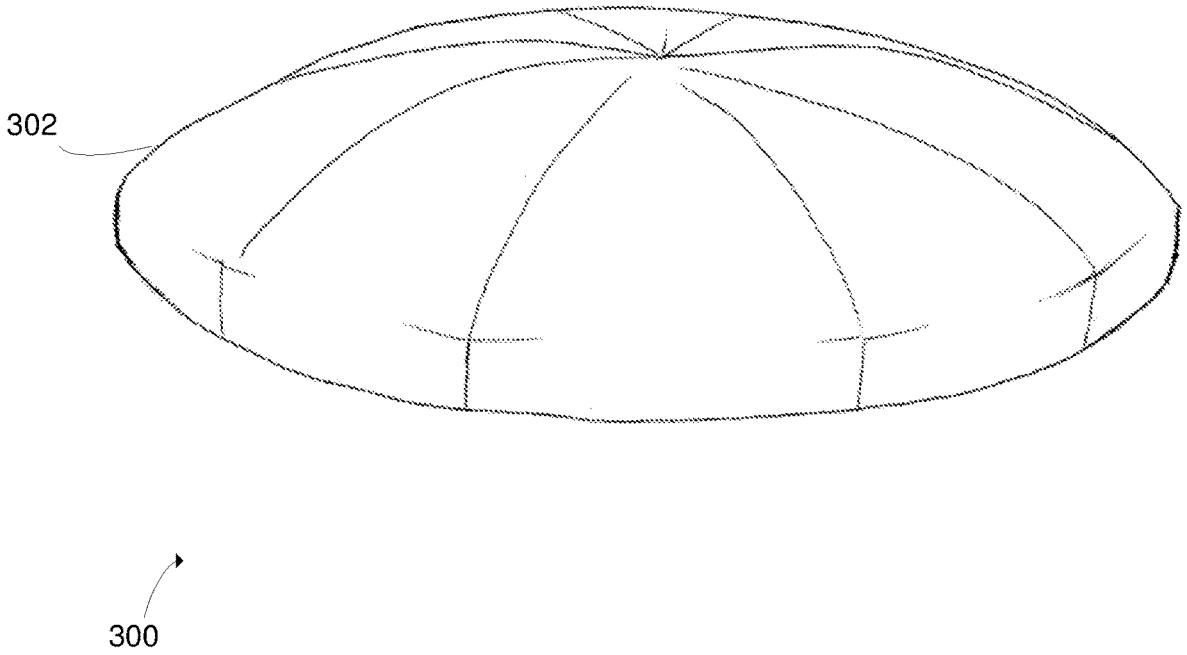
FIG. 3 illustrates an exemplary cover used with a pool.

Illustrated in FIG. 3 is an exemplary cover system 300. Illustrated is a cover 302 that is dome shaped. Although the cover 302 is illustrated as being dome shaped, it should be understood that the cover shade 302 can be any type of shapes (i.e., flat, rectangular, square-like, etc.). It should also be understood that the cover can be any type of material, such as a fabric, metal, or plastic. It should also be understood that the cover can be made of a mixture of materials, such as a metal or plastic with a fabric, where the metal or plastic provides a skeleton for the fabric to spread across. In another embodiment, the shade cover is a series of panels. It should also be understood that the cover can be configured to let a portion of sunlight pass through. This would be beneficial when swimmers want some sun, or partial shading.

In an embodiment, the cover 302 has attachment areas that allow it to be removably attached to cover holders. The cover 302 can be removable from cover holders on telescopic poles.

Figure 4:
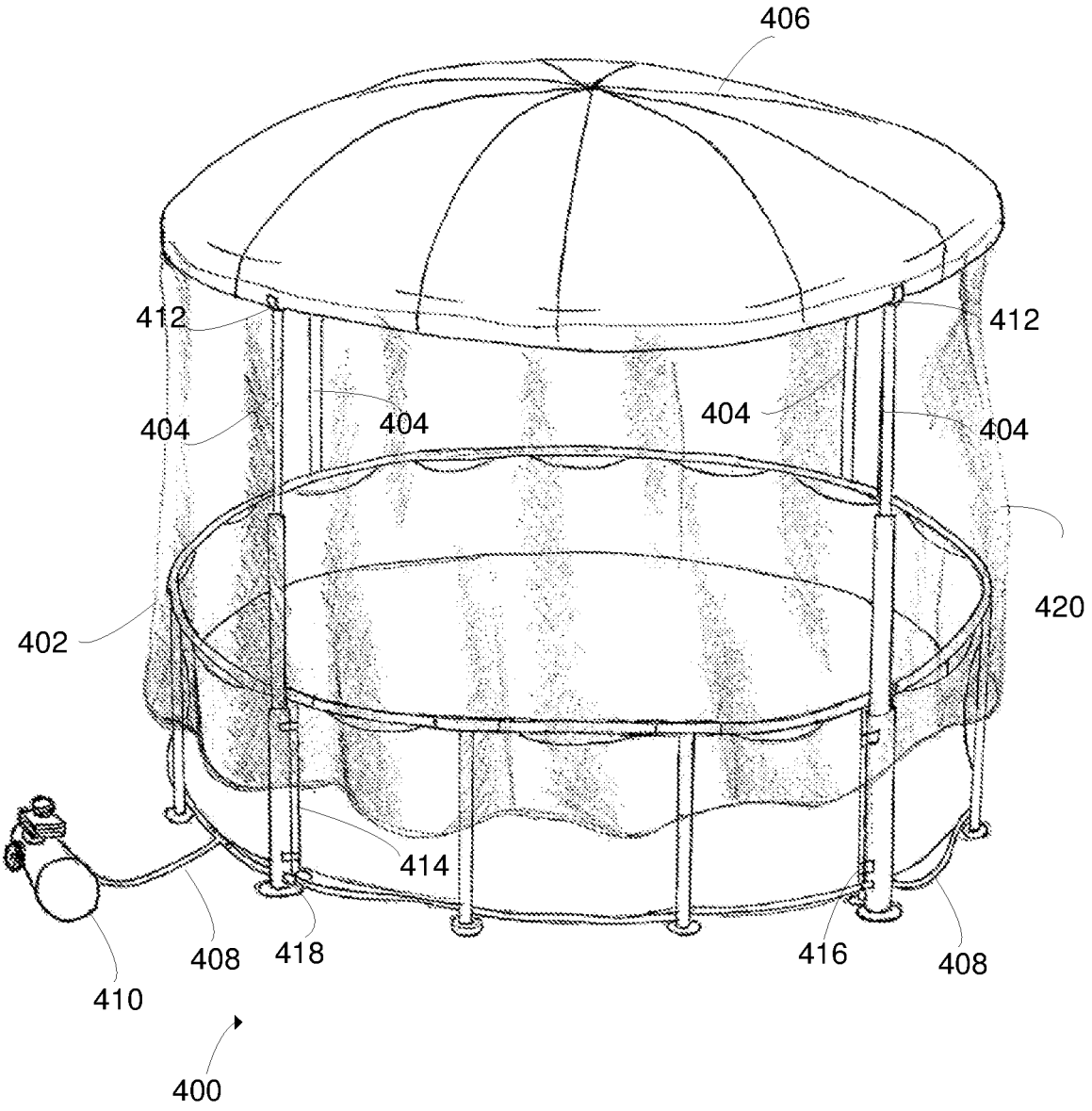
FIG. 4 illustrates an exemplary pool with a cover and mosquito net.

Shown in FIG. 4 is an exemplary pool system 400 with a mosquito net 420. An above ground pool 402 is filled with water (water not shown). The pool 402 has four telescopic poles 404 that hold up a cover 406. The telescopic poles 404 raise and lower the cover 406 using pneumatic pressure via pipes or hoses 408. An air pump 410 provides air pressure via the pipes or hoses 408 to raise and lower the telescopic poles 404. Each of the telescopic poles 404 has an entry hole 418 allowing air to go into and go out of the telescopic poles 404. Air pressure can be injected into telescopic poles 404 to raise or lower the cover 406 via a mechanically actuated valve or via electronic actuation. The cover 406 is held up via cover holders 412. The telescopic poles 404 are attached to support poles 414 of the pool 402 via clasps 416. When fully raised, the telescopic poles 404 can be locked via clamps (not shown) to lock the cover 406 in place.

Attachments, such as a mosquito net 420, can be provided to the cover 406. In an embodiment, the mosquito net 420 is removably attached to the cover 406 and, in another embodiment, the mosquito net 420 is fixably attached to the cover 406. In an embodiment, the mosquito net 420 is fixably attached to the side of the pool 402. In another embodiment, the mosquito net 420 is free hanging. In another embodiment, the mosquito net 420 can have floatable attachments (not shown) at its lower end. The floatable attachments can encircle the rim of the pool 402 to keep the lower portions of the mosquito net 420 afloat. In one embodiment, the floatable attachments may be removably fixed to the mosquito net 420.

The mosquito net 420 may keep mosquitos and other types of bugs out of the pool 402. In an embodiment, the mosquito net 420 can be attachable and removable. In another embodiment, the mosquito net 420 can be fabricated onto the cover 406. The mosquito net 420 can be made of any type of material, such as plastic, fabric, or metal.

The mosquito net 420 is illustrative. It should be understood that any type of curtain and curtain material can be used for privacy or to further reduce sun or other environmental exposure.

The cover 406, with the mosquito net 420, can be lowered to cover the pool 402. This can be done during night, during colder weather, or whenever the pool 402 is not being used. In an embodiment, the mosquito net 420 lowers into the inner portion of the pool 402. In another embodiment, the mosquito net 420 lowers into the outer portion of the pool 402. The cover 406 can be raised to provide shade to the pool 402 when in use. It should be understood that this would be desirable to protect swimmers from sun burn or when direct contact from the sun is undesirable.

In an embodiment, the cover 406 slightly overlaps the outer portion of the pool 402 to create a seal with the mosquito net 420 being on the outside or inside of cover 406. In another embodiment, the cover 406 can cover only a smaller portion of the pool 402. This may be desirable to have sections of the pool 402 that have sun and others that have shade. In yet another embodiment, the cover 406 can extend far beyond the pool 402. This may be desirable to provide shade for the entirety of sun positions. In either of these embodiments, the mosquito net 420 could be attached to an outer portion of the pool 402 so that there is complete coverage. In other embodiments, the mosquito net 420 can only cover a portion of the pool 402.

It should be understood that each of the components can be removed and reattached for easy storage. It may be desirable to store the pool during winter or whenever the space typically occupied by the pool 402 is needed for other activities. The telescopic poles 404 can be removable from the support poles 414. The cover 406 can also be removed from the cover holder 412. The pipes 408 can also be attached to the entry holes 418 via clasp or can be screwed on. The mosquito net 420 can also be removable.

Although described in the context of an above ground pool 402, it should be understood that the above ground pool 402 can be an in-ground pool or hot-tub.

Figure 5:
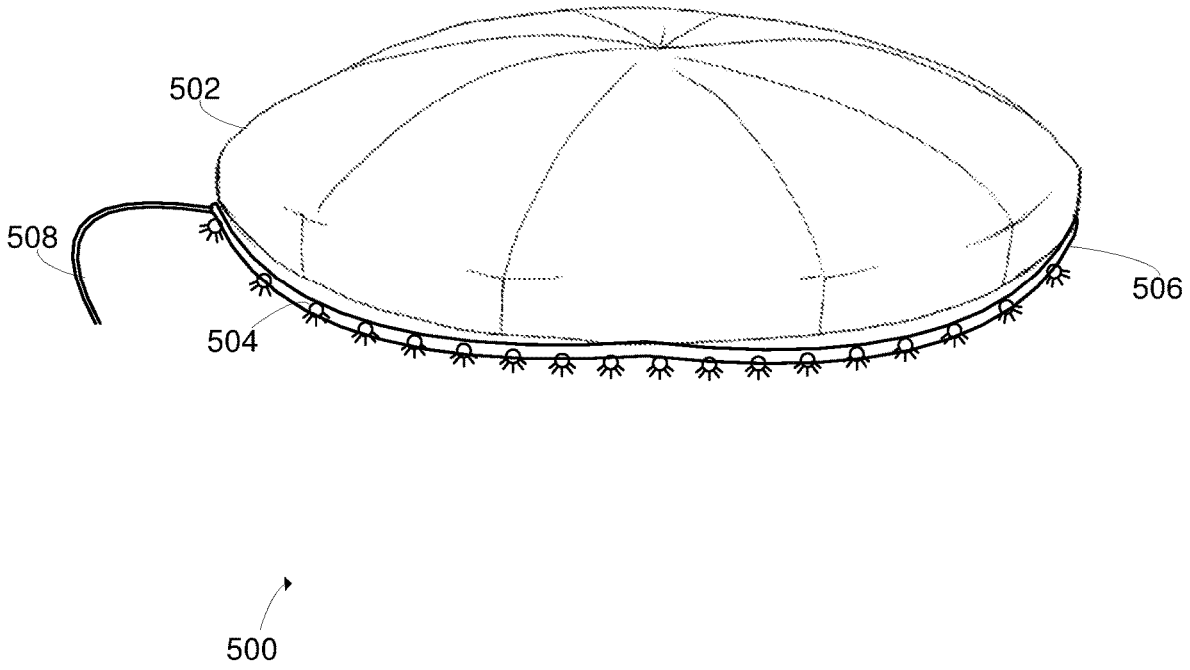
FIG. 5 illustrates an exemplary cover with misters used with a pool.

Illustrated in FIG. 5 is a cover 502 with misters 504. The misters 504 provide a mist of water. In use, the misters 504 would provide a mist to users of a pool. This would be beneficial in warmer temperatures to cool the parts of a person's body that are exposed. The misters 504 provide an environment where users of the pool can comfortable lounge when it is very hot.

The misters 504 are attached individually or collectively to one or more pipes or hoses 506 to receive water. The pipe or hose 506 obtains water from a source, such as hose 508. The hose 508 is connected to an external water source (not shown), such as a backyard hose connector, or to a pump (not shown) that supplies water from the pool to the misters 504. The pipe 506 and hose 508 can be any type of pipe or hose, plastic or metal.

In an embodiment, the misters 504 can be removably attachable to areas of the pipe 506. In another embodiment, the misters 504 can be fixably attached to the pipe 506.

In an embodiment, the pipe 506 can be removably attached to the cover 502. In another embodiment, the pipe 506 can be fixably attached to the cover 502.

It should be understood that the misters 504 and pipe 506, as discussed in FIG. 5, can also be used with the mosquito net 420, as discussed in FIG. 4. It should also be understood that the misters can be used with other embodiments disclosed herein, such as the embodiments of FIG. 1. The mosquito net 520 and misters 504 and pipe 506 can be fixably or removably attached to a cover.

Figure 6:
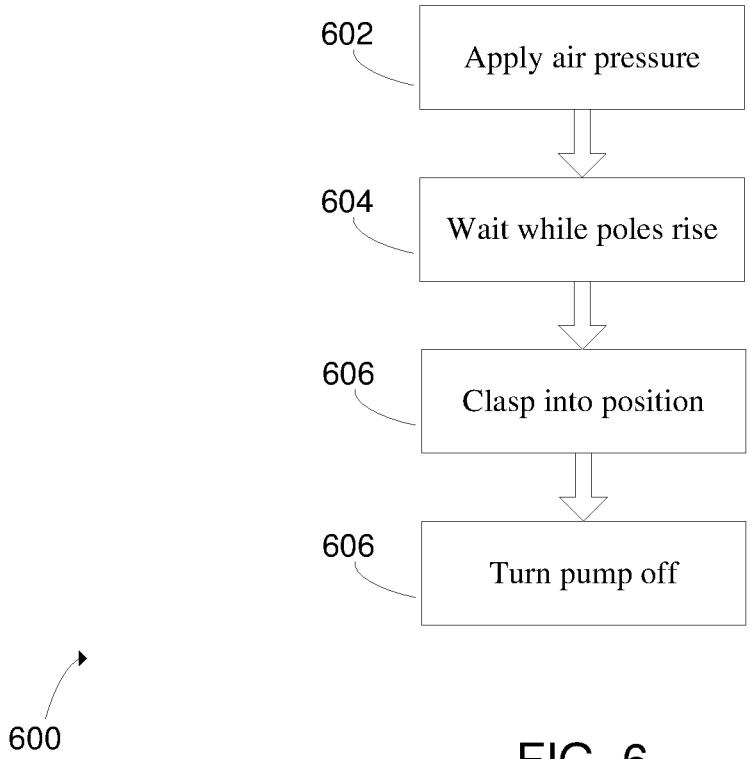
FIG. 6 illustrates an exemplary flowchart showing how to raise a cover.

FIG. 6 illustrates an exemplary flowchart 600 to raise the cover. In step 602, air pressure to the telescopic poles is applied. This is done via an air pump, and the air pump can be actuated electronically or physically. In step 604, the person waits while the poles rise to raise the cover. In step 606, the telescopic poles rise to a predetermined position where they are clasped into position. In step 608, the air pump is turned off. The air pump can be turned off via mechanical or electrical actuation.

Figure 7:
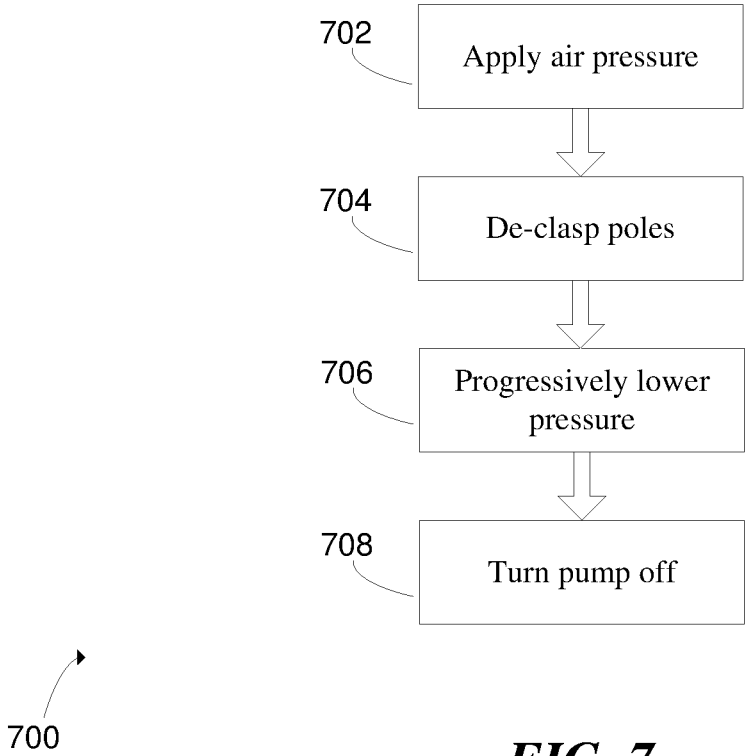
FIG. 7 illustrates an exemplary flowchart showing how to lower a cover.

FIG. 7 illustrates an exemplary flowchart 700 to lower the cover. In step 702, air pressure is applied. Air pressure can be applied via electrical or mechanical actuation of an air pump. In step 704, the telescopic poles are de-clasped. In step 706, the air pressure is progressively lowered in increments or via mechanical actuation. This is done so that the telescopic poles lower in a controlled manner so that the poles and the cover are not damaged. In step 708, the pump is turned off after the cover is lowered. The pump can be turned off or turned off via mechanical or electrical actuation.

It should be understood that steps 702, 706, and 708 can be omitted and the telescopic poles can be lowered via gravity once the poles are de-clasped in step 704.

Figure 8:
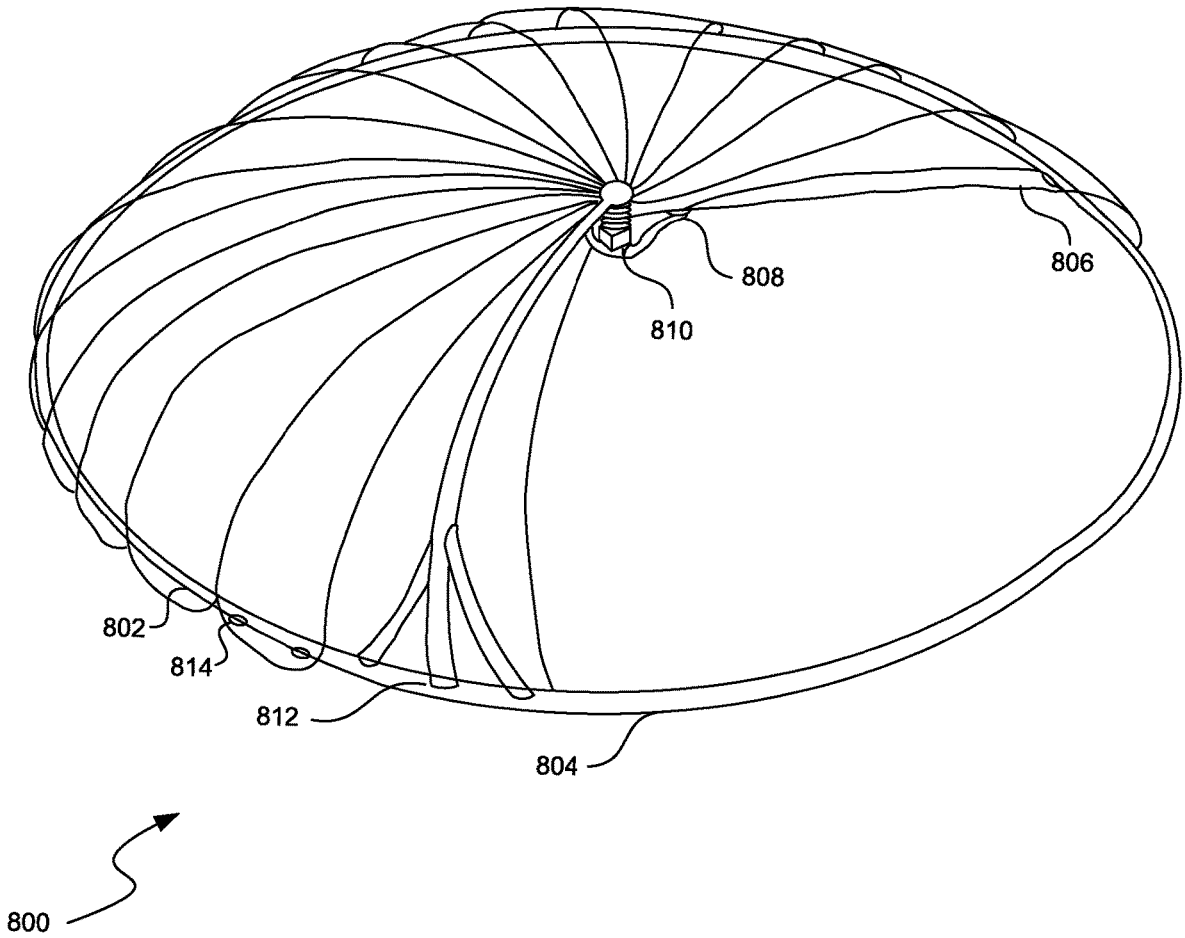
FIG. 8 illustrates an exemplary cover.

Illustrated in FIG. 8 is a cover system 800 with panels that expand and retract. The cover 800 has a series of panels 802. The panels 802 partially overlap with each other and are spread across the whole of the cover 800 along an inner rail 804. A main collector panel 806 is connected to an arm 808. The arm 808 rotates the main collector panel 806 in a clockwise and counter clockwise direction based on force applied to it by motor 810. The panels 802 are connected to the inner rail 804 via bearings 814.

In a counter clockwise direction, the main collector panel 806 collects panels 802 until the main collector panel 806 reaches final arm 812. This opens up the cover to allow more sun.

In a clockwise direction, the collector panel 806 deploys the panels 802 across the inner rail 804. The collector panel 806 fully deploys all panels across the inner rail 804 when it reaches and goes over the final arm 812. Full deployment of the panels 802 closes up the cover to provide more shade and block more sun.

The motor 810 is electric and can be triggered mechanically or electrically to deploy or collect panels 802. The motor 810 can also be configured with predetermined settings to deploy a certain predetermined number of panels 802. The panels 802 and collector panel 806 can be made of any type of fabric, metal, or plastic. In should be understood that the panels can be extended or retracted manually without the use of a motor.

It should be understood that any number of panels can be deployed to let more or less sun in. In an embodiment, a mosquito net is connected to the panels to deploy the mosquito net in the same manner that the panels are deployed. In another embodiment, misters are connected to the panels to deploy the misters in the same manner that the panels are deployed.

Figure 9:
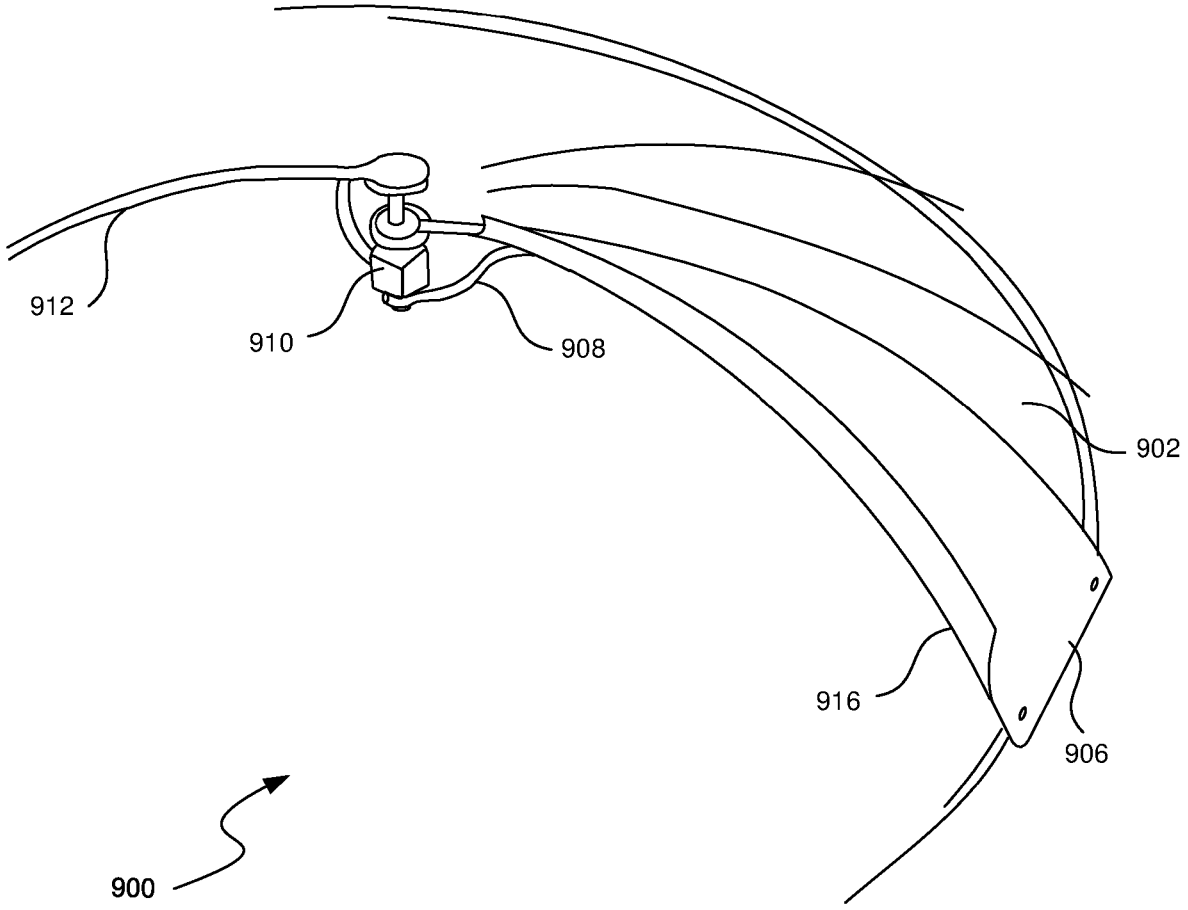
FIG. 9 illustrates a zoomed in view of an exemplary cover.

Illustrated in FIG. 9 is a zoomed in view of a cover system 900. Illustrated is the main collector panel 906 having a flap 916 that collects panels 902. Main collector panel 906 is connected to arm 908 of motor 910. Arm 908 is connected to the bottom portion of motor 910 to allow the arm 908 to movably rotate in clockwise and counter clockwise directions. It should be understood that arm 908 can be held via a bolt or other type of movably attachable mechanism. It should also be understood that each of the panels 902 and main collector panel 906 are moveably connected to the motor 910.

As illustrated in FIG. 9, the panels 902 are collected by the main collector panel 906 until it reaches final arm 912. It should also be understood that the final arm 912 can be configured to rotate to collect panels 902 until they reach the main collector panel 906.

Although shown with respect to motor 910, it should be understood that the system can work without a motor, but can instead can be physically operated by a person.

Figure 10:
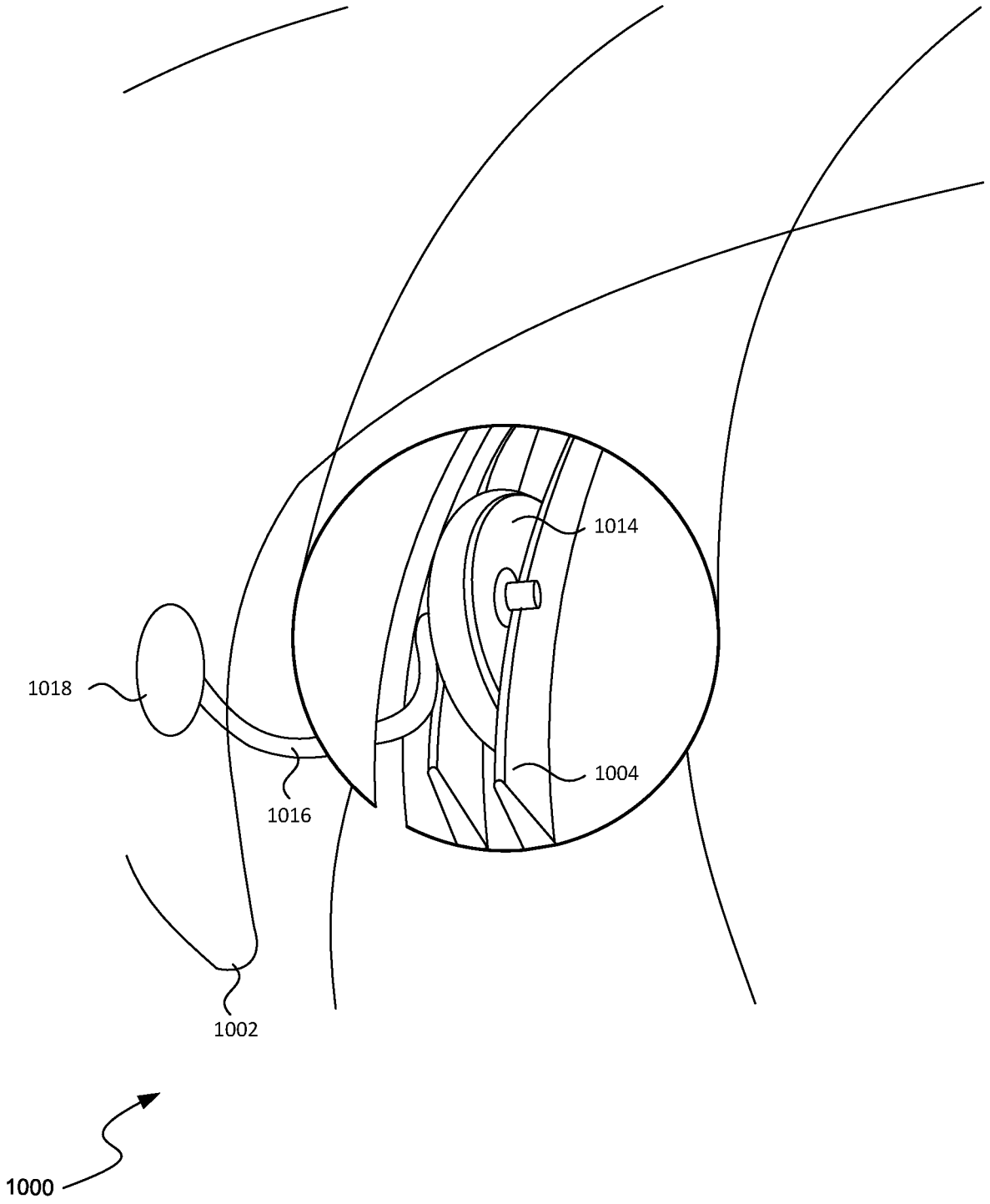
FIG. 10 illustrates an exemplary bearing of a panel.

Illustrated in FIG. 10 is a zoomed in view of a cover system 1000. A bearing 1014 is movably connected to an inner rail 1004. The bearing 1014 allows the panel 1002 to move across the inner rail 1004 to deploy the panels 1002 across the cover. The bearing 1004 is connected to the panel 1002 via panel arm 1016 connected to connector 1018.

Figure 11:
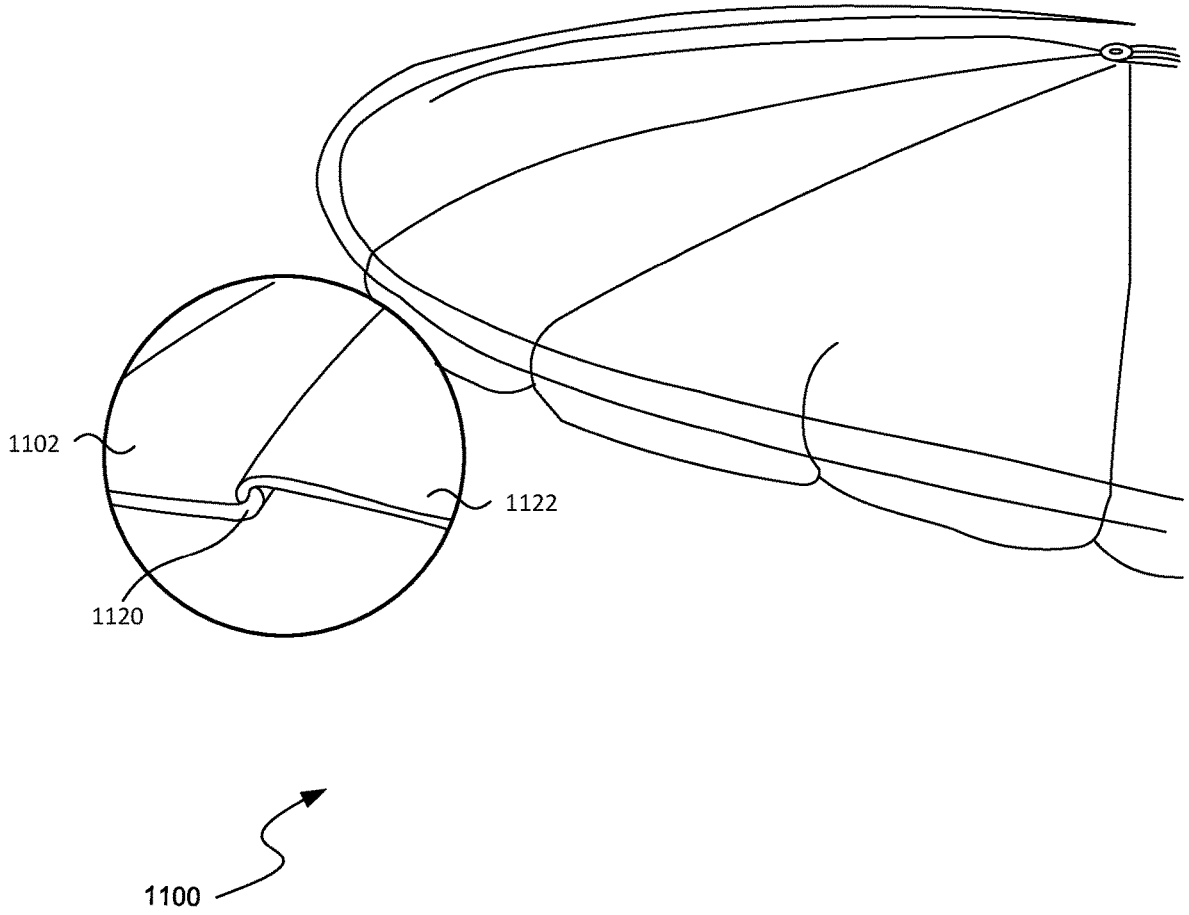
FIG. 11 illustrates interlocking panels.

Illustrated in FIG. 11 is a zoomed in few of an interlock system 1100. The left panel 1102 interlocks 1120 with the right panel 1122. The left panel 1102 is designed to go under the right panel 1122 when pushed by a main collector panel (not shown) when the motor (not shown) is rotating the main collector panel in a counter clockwise direction. When the motor operates the main collector panel in the clockwise direction, the left and right panel expand apart but are prevented from pulling completely apart because of interlock 1120. It should be understood that, in an embodiment, each panel of the cover is configured as the left and right panels 1102 and 1122.

It should be understood that many of the embodiments of the disclosure have been discussed simply. Many plumbing systems, connectors, valves, and other leakage prevention systems are understood to be known in the art. For simplicity, these have not been described.

It should also understood that, while portions of the disclosure describe a pipe or hose, that any type of connector to transfer water can be used.

While this patent document contains many specifics, these should not be construed as limitations on the scope of any invention or of what may be claimed, but rather as descriptions of features that may be specific to particular embodiments of particular inventions. Certain features that are described in this patent document in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. Moreover, the separation of various system components in the embodiments described in this patent document should not be understood as requiring such separation in all embodiments.

Only a few implementations and examples are described and other implementations, enhancements and variations can be made based on what is described and illustrated in this patent document.

What is claimed are techniques and structures as described and shown, including:

1. A system, comprising:

at least one pole, the pole being configured to raise and lower vertically via a change in air pressure within the pole, wherein the pole has at least one entry point, the entry point allowing an external pump to connect to it via a connector, the pole being attachable to at least one portion of a pool, the external pump being electrically actuated and connected to the entry point, wherein the external pump has predetermined settings that can be actuated by a user to raise the poles to a predetermined height; and a cover, the cover being configured to raise and lower with the at least one pole, wherein the cover comprises (a) a series of panels that expand out over the cover, (b) a collector panel that collects the series of panels to retract the panels from the cover, (c) a motor that rotates the collector panel in a clockwise and counter clockwise direction, wherein the motor is configured with settings to deploy a predetermined number of the series of panels in a clockwise or counter clockwise direction.

2. The system according to claim 1, further comprising a support pole, the pole being connectable to the support pole.

3. The system according to claim 1, further comprising an above ground pool, the pole being connectable to the above ground pool.

4. The system according to claim 1, further comprising an in-ground pool, the pole being connectable to a surface around the in-ground pool.

5. The system according to claim 1, further comprising a connector, the connector being connectable to the entry point and an external pump.

6. The system according to claim 1, wherein the pole further comprises cover holders.

7. The system according to claim 1, wherein the pole further comprises a clasp, the clasp allowing the cover to be held in place at a predetermined height.

8. The system according to claim 1, further comprising a mosquito net, the mosquito net attachable to the cover.

9. The system according to claim 1, further comprising at least one mister attachable to the cover.

10. The system according to claim 9, wherein the mister is attachable to the cover via a connector.

11. The system according to claim 10, wherein the connector is attachable to a second connector, the connector being connectable to an external water source.

12. The system according to claim 1, wherein the poles are configured to be raised and lowered via an electrically actuated external pump.

13. A system, comprising:

means to support a cover shade, the means to support a cover shade comprising at least one pole, the pole being configured to raise and lower vertically via a change in air pressure within the pole, wherein the pole has at least one entry point, the entry point allowing an external pump to connect to it via a connector, the pole being attachable to at least one portion of a pool, the external pump being electrically actuated so that it can be actuated by a user to raise the poles to a predetermined height, and wherein the cover shade comprises (a) a series of panels that expand out over the cover, (b) a collector panel that collects the series of panels to retract the panels from the cover, (c) a motor that rotates the collector panel in a clockwise and counter clockwise direction, wherein the motor is configured with settings to deploy a predetermined number of panels; and means to attach the means to support the cover shade to a pool.

14. The system according to claim 13, further comprising means to provide misting.

15. The system according to claim 13, further comprising means to provide protection from bugs.

16. The system according to claim 13, further comprising a clasp, the clasp allowing the cover to be held in place at a predetermined height.

* * * * *